United States Patent [19]

Krips et al.

[11] Patent Number: 4,827,605

[45] Date of Patent: May 9, 1989

[54] APPARATUS FOR SECURING STRAIGHT TUBES BETWEEN TWO TUBE SHEETS IN A PRESSURE-TIGHT MANNER

[75] Inventors: Herbert Krips, Bochum; Miroslan Podhorsky, Ratingen, both of Fed. Rep. of Germany

[73] Assignee: Balcke-Dürr Aktiengesellschaft, Ratingen, Fed. Rep. of Germany

[21] Appl. No.: 219,458

[22] Filed: Jul. 15, 1988

Related U.S. Application Data

[62] Division of Ser. No. 27,325, Mar. 18, 1987, Pat. No. 4,782,571.

[30] Foreign Application Priority Data

Apr. 3, 1986 [DE] Fed. Rep. of Germany ..... 3611108

[51] Int. Cl.[4] ..... B23P 15/26

[52] U.S. Cl. ..... 29/727; 29/157.3 C; 29/523; 72/61; 72/62

[58] Field of Search ..... 29/707, 715, 727, 157.3 C, 29/523, 447, 446; 72/13, 61, 62, 370, 342

[56] References Cited

U.S. PATENT DOCUMENTS

| | | | |
|---|---|---|---|
| 2,941,569 | 6/1960 | Holt et al. | 29/715 |
| 3,628,227 | 12/1971 | Blackburn et al. | 29/715 |
| 3,683,481 | 8/1972 | Blackburn et al. | 29/715 |
| 4,407,150 | 10/1983 | Kelly | 72/61 |
| 4,485,547 | 12/1984 | Busse | 72/62 |
| 4,649,493 | 3/1987 | Castner et al. | 72/61 |

*Primary Examiner*—Carl E. Hall
*Assistant Examiner*—Irene Cuda
*Attorney, Agent, or Firm*—Becker & Becker, Inc.

[57] ABSTRACT

An apparatus for securing straight tubes between two tube sheets in a pressure-tight manner, especially in the manufacture of heat exchangers. Tubes are inserted, with play, in bores of the tube sheets. One end of each tube is hydraulically expanded via a pressure medium to thereby press this one end against the associated tube sheet. The one end is secured to the associated tube sheet, preferably by being welded thereto. Each tube is heated in conformity with a prescribed prestress that is to be produced in secured ones of the tube to take into account subsequent operation conditions to push a portion of the non-secured other end of the tube out of its associated tube sheet until a predetermined difference in length between the cold and heated-up states of the tube is pushed out. That portion of the other end of the tube that is disposed in one of the bores of the tube sheets is hydraulically expanded, whereupon the pushed-out end portion of the tube is secured to its associated tube sheet, preferably by being welded thereto. The expansion resulting from heating the tube is used as a control signal for the hydraulic expansion process. For this purpose, a switch for the valve for supplying pressure medium to the annular chamber is disposed on the expansion mechanism, with this switch being adapted to be activated by the end face of the tube that expands due to heat.

6 Claims, 4 Drawing Sheets

APPARATUS FOR SECURING STRAIGHT TUBES BETWEEN TWO TUBE SHEETS IN A PRESSURE-TIGHT MANNER

This is a divisional application of allowed copending parent application Ser. No. 027,325-Krips et al filed Mar. 18, 1987 now U.S. Pat. No. 4,782,571, belonging to the assignee of the present invention.

BACKGROUND OF THE INVENTION

The present invention relates to an apparatus for securing straight tubes between two tube sheets in a pressure-tight manner, especially in the manufacture of heat exchangers.

German Pat. No. 24 56 811-Krips dated June 19, 1976 belonging to the assignee of the present invention, discloses a method of securing straight tubes between two tube sheets. In this heretofore known method, subsequent to a hydraulic expansion of the tube ends in the vicinity of the tube sheets, an additional rolling-on of the tubes in the expanded region of at least one of the tube sheets is effected in order to produce a predetermined state of stress in the tubes that are disposed between the two tube sheets so that no overstressing of the tubes occurs in the later operating state.

With this known method, the state of stress in the individual tubes can be prescribed very precisely. However, the additional rolling-on process requires a considerable amount of time and effort.

It is an object of the present invention to simplify the heretofore known method and to produce a predetermined state of stress in the tubes that are secured between the two tube sheets in a single procedural step accompanied by securing of the tubes in the tube sheets.

BRIEF DESCRIPTION OF THE DRAWINGS

This object, and other objects and advantages of the present invention, will appear more clearly from the following specification in conjunction with the accompanying schematic drawings, which illustrate exemplary embodiments of the inventive apparatus as well as a number of the procedural steps of the inventive method, and in which.

SUMMARY OF THE INVENTION

Figure 1:
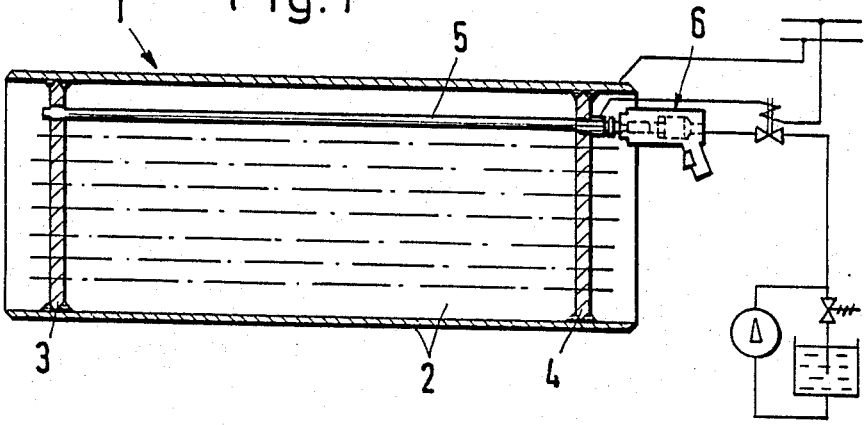
FIG. 1 is a schematic overall view.

The procedure of the present invention includes the following steps: inserting the tubes, with play, in bores of the tube sheets; hydraulically expanding one end of each tube via a pressure medium to thereby press said one end against the associated tube sheet; securing said one end, in the end face region thereof, to the associated tube sheet, preferably by welding it thereto; heating each tube, in conformity with a prescribed prestress that is to be produced in secured ones of the tubes to take into account subsequent operating conditions, to push a portion of the non-secured other end of the tube out of its associated tube sheet until a predetermined difference in length between the cold and heated-up states of the tube is pushed out; hydraulically expanding that portion of the other end of the tube that is disposed one of the bores of the tube sheet; and securing the pushed-out end portion of the tube to its associated tube sheet, preferably by welding it thereto.

Pursuant to the inventive disclosure, the predetermined state of stress is produced without an additional operation and merely by a selective heating of each tube prior to its hydraulic expansion and securement to the second tube sheet. This state of stress results automatically as soon as all of the tubes have been mounted between the tube sheets and have cooled off. During the successive mounting of the individual tubes, deviating states of stress can result in the individual tubes; however, after conclusion of the mounting process, these deviating states of stress transform to the predetermined values, since the latter are a function of the total number of tubes disposed between the tube sheets and of the resulting deformation of the latter.

A further advantage of the inventive disclosure is that not only the initial securing of the one tube end to the associated tube sheet, but also the welding of the other tube end to the second tube sheet, is effected in the absence of stresses in the securing region, because the tube end is previously fixed in position relative to the tube sheet by the hydraulic expansion. Consequently, all of the weld seams can be accomplished with no problems; in addition, the weld seams can be tested without difficulty.

To improve the seating of the tubes in the tube sheets, which seating is produced merely by the hydraulic expansion, it is proposed pursuant to a further feature of the present invention to form recesses in the tube sheets in the region of the bores thereof; the tubes are expanded into these recesses to increase the holding force.

A rapid and clean heating of the tubes is inventively achieved by introducing a heating element into that tube end that is already secured to one of the tube sheets.

Pursuant to a further feature of the inventive disclosure, it is proposed to use the expansion that results from heating the tubes as a control signal for the hydraulic expansion process. This simplifies the execution of the inventive method, and eliminates errors that could be caused by an operator.

Pursuant to one preferred embodiment of the invention, at least at one tube sheet the tubes can be welded to the tube sheet through the interposition of an additional tubular sleeve that extends around a projection of the tube beyond the tube sheet. These tubular sleeves, one end of which is welded to the tube sheet prior to the mounting of the tubes, simplify application of the weld seams between the ends of the tube and the tube sheet, with these weld seams serving not only to fix the position of the tubes relative to the tube sheet, but also guaranteeing a satisfactory seal between the tubes and the tube sheet.

The apparatus for carrying out the inventive disclosure utilizes an expansion probe or mechanism that can be introduced into a respective tube that is to be expanded. By means of at least two spaced apart sealing rings disposed on the cylindrical body of the probe or mechanism, the latter forms an annular chamber with that portion of the tube that is to be expanded. For the expansion process, after a valve is opened, this annular chamber is supplied with pressure medium that is delivered from a source of pressure medium.

In order for such an apparatus to achieve an immediate expansion of the respective tube end as soon as the latter, due to heating of the tube, projects out of the end face of the tube sheet by the predetermined difference in length a switch or controller for the valve for the supply of pressure medium to the annular chamber is inventively disposed on the expansion probe or mechanism; this switch can be activated by the end face of the tube that expands due to the heating process.

As a consequence of this inventive configuration of the expansion mechanism, after the introduction of the cylindrical body of the mechanism into the respective tube that is to be expanded, and after the selective heating of this tube, an automatic initiation of the hydraulic expansion process results, since the tube, which expands due to the heating, opens the valve via the switch disposed on the expansion mechanism; this valve conveys pressure medium from a source thereof into the annular chamber, which is delimited in the axial direction by at least two spaced apart sealing rings that are disposed on the cylindrical body of the expansion mechanism. Thus, an operator does not have to measure the temperature or the difference in length, but need only assure that the expansion mechanism is properly set against the tube sheet wit the tube that is to be expanded.

Pursuant to a preferred embodiment of the present invention, the switch includes an abutment ring that concentrically extends around the cylindrical body of the expansion mechanism. The distance (measured in the axial direction of the expansion mechanism) of the abutment ring from the tube sheet, or from the end face of the cold tube that is to be expanded, can be set in conformity to the predetermined difference in length. This setting can be effected either by exchanging different abutment rings, or by adjusting the abutment ring relative to the abutment surface or end face of a housing that surrounds the cylindrical body of the expansion mechanism.

Pursuant to a preferred embodiment of the inventive apparatus, the abutment surface of the expansion mechanism against the tube sheet is formed by a housing collar that is adjustable in the axial direction of the cylindrical body of the mechanism; the abutment ring of the switch is disposed in the interior of this collar. In this way it is possible to adjust not only the proper position of the sealing rings inwardly of the respective tube sheet, possibly taking into consideration a predetermined projection of the tube that is to be expanded, or an interposed tubular sleeve, but also the predetermined difference in length, which is achieved, with regard to the later state of stress of the tube, by heating, and which, when achieved, is to be utilized as the control signal for the initiation of the hydraulic expansion process. Further specific features of the present invention will be described in detail subsequently.

DESCRIPTION OF PREFERRED EMBODIMENTS

Referring now to the drawings in detail, the schematic illustration of FIG. 1 shows a heat exchanger 1 that includes two tube sheets 3 and 4 that are welded into a housing 2; a plurality of straight tubes 5 extend between the tube sheets 3, 4. All but one of these tubes 5 is shown merely by dot-dash lines.

The tubes 5 are inserted with play in prepared bores of the tubes sheets 3 and 4; using an expanding probe or mechanism 6, the tubes 5 are hydraulically expanded with a pressure medium. As a result of this expansion, parts of the tubes 5 are pressed against the tube sheets 3 and 4. The end face regions of the tubes 5 are subsequently secured to the respective tube sheets 3 or 4, preferably by being welded thereto.

Figure 2:
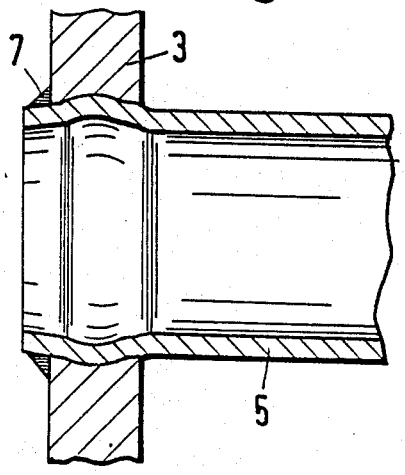
FIG. 2 is a longitudinal, cross-sectional view of the first end of a tube that is secured in one of the tube sheets.

As shown in the cross-sectional views of FIGS. 2 to 8, a hydraulic expansion is effected first at that end of the tube 5 which is disposed in the tube sheet 3. The tube 5 is pressed against a recess formed in the region of the respective bore of the tube sheet 3; the tube 5 is thereupon welded to the outside of the tube sheet 3. FIG. 2 shows the weld seam 7, which serves both a positioning and sealing function. Instead of a hydraulic expansion, the tubes 5 could also be secured in the tube sheet 3 by being rolled in or by welding only.

Figure 3:
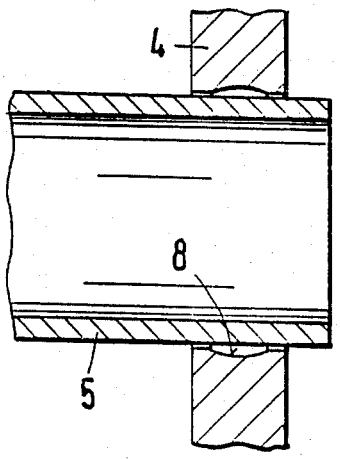
FIG. 3 is a cross-sectional view through the other end of this tube which projects out of the appropriately prepared bore of the other tube sheet.

After the process of securing the tube 5 to the tube sheet 3 is concluded, the other end of the tube 5 projects slightly beyond the tube sheet 4, as shown in FIG. 3. FIG. 3 also shows that in the region of the respective bore in the tube sheet 4, a recess 8 is formed into which the tube 5 is pressed during hydraulic expansion to increase the retention force.

Figure 4:
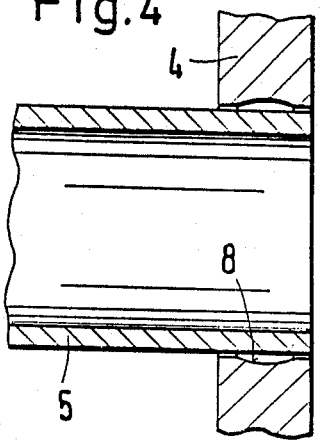
FIG. 4 is a cross-sectional view similar to that of FIG. 3 where the length of the tube end has been cut off to the desired dimension.

After one end of all of the tubes 5 have been hydraulically expanded in the tube sheet 3 and have been secured to the latter via a weld seam 7, the other end of the tubes 5 project beyond the tube sheet 4, as shown in FIG. 3, whereupon these projecting ends are cut to the desired length, as shown in FIG. 4. It is, of course, also possible to dispense with cutting the tubes 5 to length to the extent that a prescribed projection of the tubes 5 beyond the end face of the tube sheet 4 is intended, which projection is to be maintained within permissible tolerances even after the tubes 5 are secured in the tube sheet 4.

Figures 5, 6:
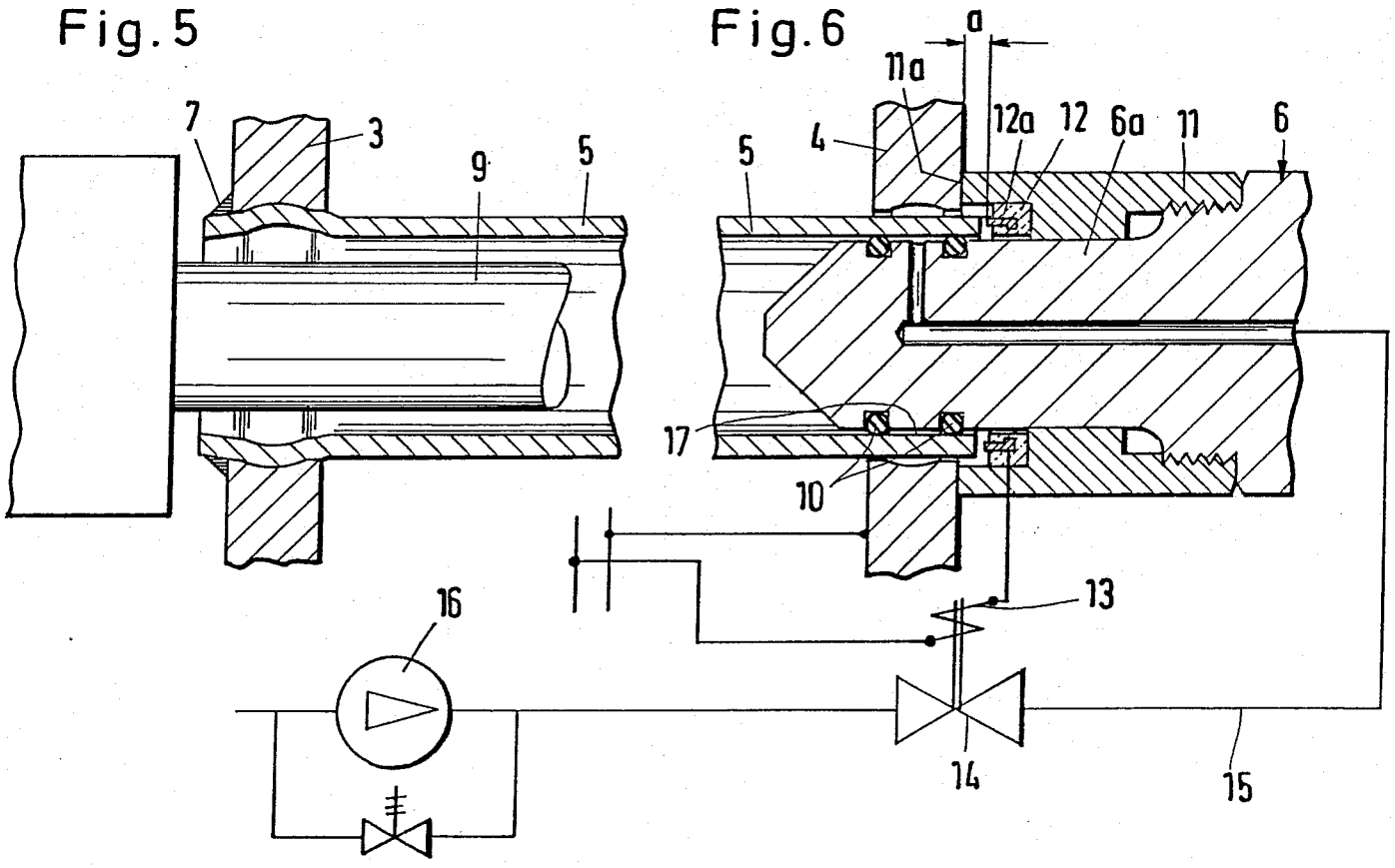
FIG. 5 is a cross-sectional view of the first secured end of the tube after a heating element has been introduced therein.
FIG. 6 is a cross-sectional view corresponding to that of FIG. 4 after the expansion mechanism has been introduced and during the heating process.

As shown in FIGS. 5 and 6, to heat the tube 5 a heating element 9 is inserted into that end thereof that is secured to the tube sheet 3. FIG. 6 shows how, due to this heating action, the tube 5 has increased in length and, despite having previously been cut to length to coincide with the end face of the tube sheet 4, has been pushed slightly beyond the end face of the tube sheet 4.

Now, as also shown in FIG. 6, the cylindrical body **6*a* of the expanding probe or mechanism 6 is inserted into the free end of the tube 5 in such a way that the sealing rings 10, which are spaced from one another on this body 6*a*, are disposed just within the thickness of the wall of the tube sheet 4. In order to assure this coordination of the sealing rings 10 of the mechanism body 6*a* with the tube sheet 4, a collar 11 is screwed onto the housing of the expansion mechanism 6; the end face 11*a*** of the collar 11 rests against the outer surface of the tube sheet 4. Appropriately adjusting the collar 11 relative to the mechanism body 6a assures that the sealing rings 10 are always in the correct position within the cross-sectional area of the tube sheet 4 when the expansion mechanism 6 is properly brought into contact against the tube sheet 4.

Figure 7:
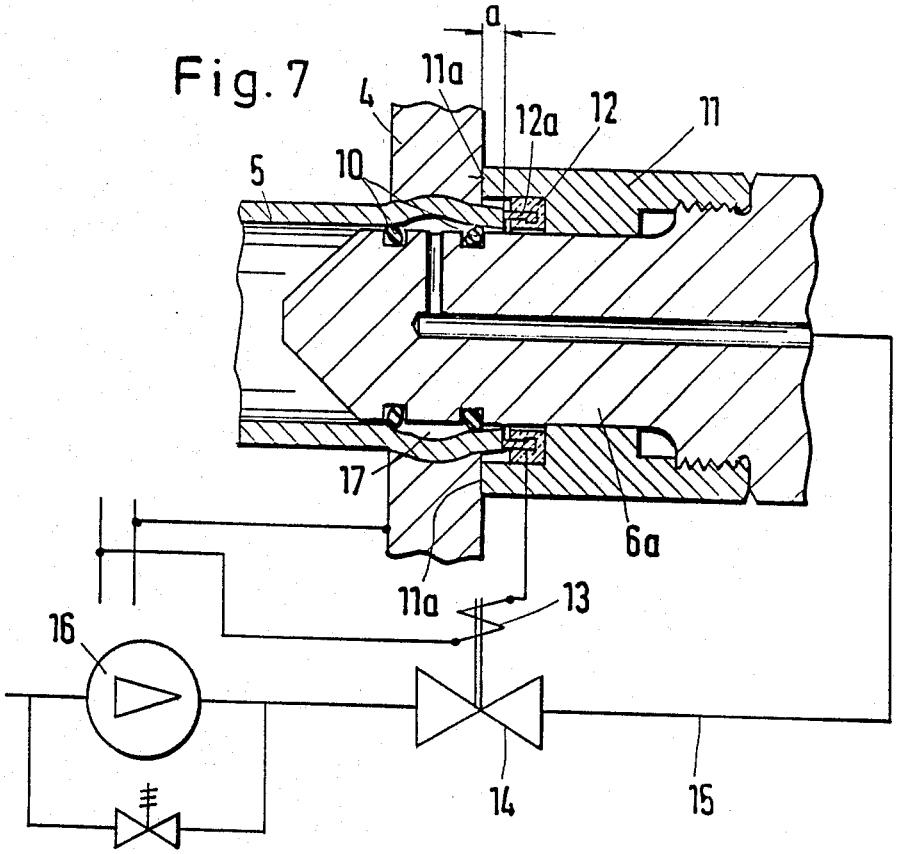
FIG. 7 is a cross-sectional view corresponding to that of FIG. 6 after conclusion of the heating process and after the hydraulic expansion has taken place.
Figure 8:
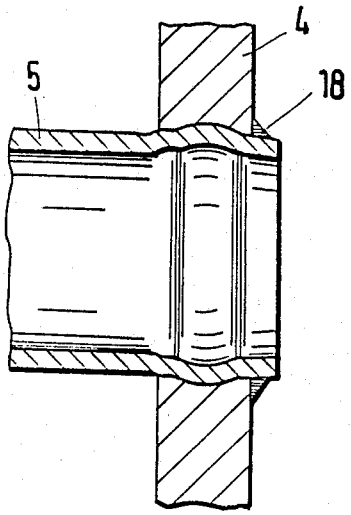
FIG. 8 is a cross-sectional view through the tube end illustrated in FIGS. 6 and 7 after hydraulic expansion and welding of the tube to the tube sheet.

In the embodiment illustrated in FIGS. 6 and 7, an abutment ring 12 is disposed within the housing collar 11. One or more contact pins 12a extend out of the front end face of the abutment ring 12. The forward surface of each contact pin 12a is disposed at a predetermined distance "a" from the tube sheet 4. In the illustrated embodiment, this distance "a" also corresponds to the difference in length that is produced by heating the tube 5, and that, after the tube 5 is secured and then cooled off, is furthermore responsible for the creation of a preload in the tube 5 that is welded between the tube sheets 3 and 4.

As soon as the tube 5 has been lengthened to the desired extent by being heated via the heating element 9, that end face of the tube 5 that projects out of the tube sheet 4 comes to rest against the contact pins 12a, as shown in FIG. 7. These contact pins 12a are part of a switch or controller 13 that controls a valve 14 which is disposed in the pressure medium line 15 and extends from a source 16 of pressure medium to the expansion mechanism 6. In the mechanism 6, the pressure medium line 15 opens into the annular chamber 17, the axial dimension of which is delimited by the sealing rings 10. In the vicinity of this annular chamber 17, the tube 5 is expanded and is pressed against the bore and the recess 8 of the tube sheet 4 as soon as the valve 14 is opened.

FIG. 7 shows the end of the tube 5 during the hydraulic expansion after the appropriate tube section has already pressed against the bore and the recess 8 of the tube sheet 4. As soon as a preset pressure has been reached within the annular chamber 17 and has been maintained for a certain period of time, the pressure is reduced and the expansion mechanism 6 is withdrawn from the tube 5. Subsequently, that end of the tube 5 that projects beyond the tube sheet 4 is welded to the latter via a weld seam 18.

Before the tube 5 is connected to the tube sheet 4 both by expansion and by welding, this tube is projected a certain amount out of the tube sheet 5 on the one hand due to the difference in length between the cold tube 5 and the tube after it has been heated up by the heating element 9, with this difference in length being predeterminable by the distance "a", and on the other hand due to the automatic initiation of the hydraulic expansion process when this difference in length is achieved. During the subsequent cooling of the tube 5, tensile stresses result in this tube. Taking into consideration the deformations of the tube sheets 3 and 4 that are welded in the housing 2, these tensile stresses result in the desired state of stress in the tubes 5. In this connection, it is quite possible that different stresses may be desired in different ones of the tubes 5. Consequently, it is possible to have different ones of the tubes 5 project differing distances out of the tube sheet 4 before these tubes are secured to the tube sheet. For this purpose, the abutment ring 12 within the housing collar 11 can be adjustable or can be replaced by a different abutment ring 12 that maintains a different distance "a" relative to the end face of the tube sheet 4.

Figure 9:
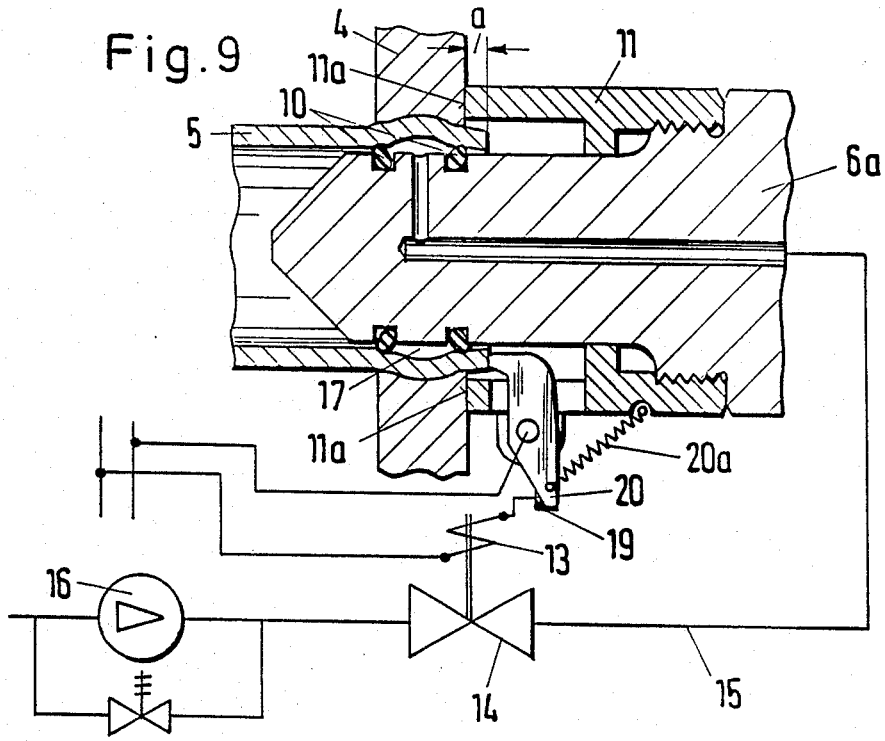
FIG. 9 is a cross-sectional view similar to that of FIG. 6 of an alternative embodiment of the inventive apparatus.
Figure 10:
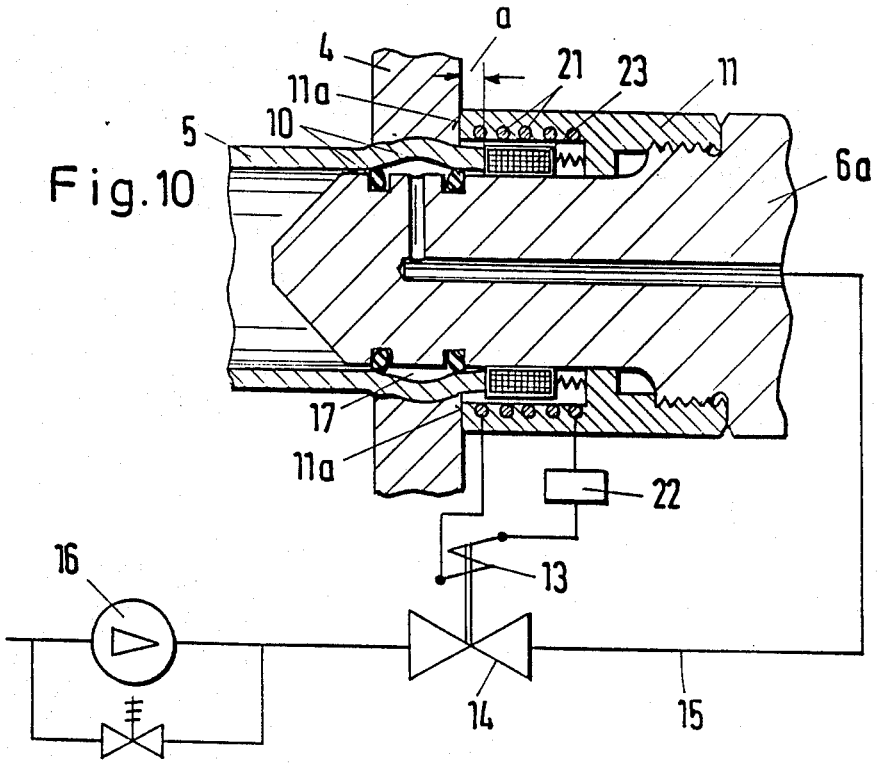
FIG. 10 is a cross-sectional view of yet another exemplary embodiment of the inventive apparatus.

Two further exemplary embodiments for the switch 13 to control the valve 14 are illustrated in FIGS. 9 and 10. In the embodiment illustrated in FIGS. 6 and 7, the contact pins 12a in the electrically non-conductive abutment ring 12 are incorporated in the power circuit of the switch 13 in such a way that contact of the pins 12a by the end face of the expanding tube 5 results in actuation of the switch 13. In contrast, in place of an abutment ring 12 having contact pins 12a, the embodiment of FIG. 9 uses a switch or control lever 20 that is pivotably mounted on the housing collar 11 and that cooperates with a contact 19 of the switch 13. Normally, the switch lever 20, which is loaded by the spring 20a, is lifted off of the contact 19. However, if the switch lever 20 is pivoted in a clockwise direction by the expanding end face of the tube 5 (FIG. 9) the lever 20 comes to rest against the contact 19 as soon as the tube 5 has expanded by the distance "a". At this moment, the switch 13 effects an opening of the valve 14 in the manner described in connection with the first embodiment.

In the third embodiment, illustrated in FIG. 10, the switching or controlling process is triggered by an induction coil 21 that is disposed in the housing collar 11. In this embodiment, a magnetic ring 23 is disposed inwardly of the induction coil 21, which is connected to the switch 13 via an amplifier 22. The magnetic ring 23 is moved by the end face of the expanding tube 5 and, as soon as the end face of the tube 5 has projected beyond the end face of the tube sheet 4 by the amount "a", the magnetic ring 23 delivers to the valve 14 a control signal that is amplified by the amplifier 22. This embodiment can also be modified to establish electrical contact in a non-contact manner if, in place of the magnetic ring 23, that part of the tube 5 that projects beyond the tube sheet 4 is relied upon to trigger the signal that is to be emitted by the induction coil 21.

To summarize the three described exemplary embodiments, in one embodiment the expanding tube is integrated directly into the circuit of the switch 13 (FIGS. 6 and 7). In the second embodiment (FIG. 9), the switching or control contact is produced in a mechanical manner. The last embodiment (FIG. 10) shows a non-contact switch, which could just as well be a photo cell that responds to the expanding end face of the tube 5.

The present invention is, of course, in no way restricted to the specific disclosure of the specification and drawings, but also encompasses any modifications within the scope of the appended claims.

What we claim is:

1. An apparatus for securing straight tubes between two tube sheets in a pressure-tight manner by hydraulically expanding said tubes, with each of said tubes having two oppositely disposed ends and associated end faces, and with each of said tube sheets having bores for receiving respective ones of said tubes; said apparatus comprising:

an expansion mechanism adapted to be introduced into a tube that is to be expanded, with said mechanism having a cylindrical body on which are disposed at least two spaced-apart sealing rings which, together with that portion of said tube that is to be hydraulically expanded, form an annular chamber;

a source of pressure medium;

a line leading from said source to said annular chamber to fill the latter with pressure medium to effect said hydraulic expansion;

a valve that is disposed in said line and that can be opened and closed to control the flow of pressure medium to said annular chamber; and a switch disposed on said expansion mechanism for controlling the opening and closing of said valve, with said switch being adapted to be activated by one of said end faces of said tube, into which said mechanism is introduced, as a result of thermal expansion of said tube.

2. An apparatus according to claim 1, in which said switch includes an abutment ring that extends concentrically around said cylindrical body of said expansion mechanism.

3. An apparatus according to claim 2, in which said abutment ring is spaced a given distance, as measured in the axial direction of said expansion mechanism, from one of said tube sheets and from said one end face of said tube in the cold state of the latter, with said distance being adjustable.

4. An apparatus according to claim 3, which includes exchangeable, different abutment rings to effect adjustment of said distance.

5. An apparatus according to claim 3, which includes a housing that extends around said cylindrical body of said expansion mechanism, with said abutment ring being displaceable relative to an abutment surface of said housing to effect adjustment of said distance.

6. An apparatus according to claim 3, which includes a collar that is disposed on said cylindrical body of said expansion mechanism in such a way as to be movable in the axial direction thereof, with said collar providing an abutment surface for said expansion mechanism against said one tube sheet, and with said abutment ring of said switch being disposed within said collar.

* * * * *